US006095792A

United States Patent [19]

Berger et al.

[11] Patent Number: 6,095,792

[45] Date of Patent: Aug. 1, 2000

[54] FLUE GAS RECIRCULATION SYSTEM AND METHOD

[75] Inventors: Eric L. Berger, Bakersfield, Calif.; Karl W. Kolthoff, Shaw Centre, Singapore; Thomas J. Rankin, Bakersfield, Calif.

[73] Assignee: Texaco Inc., White Plains, N.Y.

[21] Appl. No.: 09/137,706

[22] Filed: Aug. 21, 1998

[51] Int. Cl.[7] ..... F23C 9/00

[52] U.S. Cl. ..... 431/9; 431/4; 431/5; 431/12; 431/115

[58] Field of Search ..... 431/4, 5, 9, 115, 431/116, 12; 110/205, 206, 207, 188, 190, 234

[56] References Cited

U.S. PATENT DOCUMENTS

| | | | |
|---|---|---|---|
| 4,030,874 | 6/1977 | Vollerin | 431/115 |
| 4,609,342 | 9/1986 | Showalter | 431/115 |
| 4,659,305 | 4/1987 | Nelson et al. | 431/9 |
| 4,926,765 | 5/1990 | Dreazler et al. | 431/115 |
| 5,002,484 | 3/1991 | Lofton et al. | 432/222 |
| 5,040,470 | 8/1991 | Lofotn et al. | 110/234 |
| 5,147,200 | 9/1992 | Knopfel et al. | 431/215 |
| 5,415,195 | 5/1995 | Stoy et al. | 137/8 |
| 5,511,971 | 4/1996 | Benz et al. | 431/115 |
| 5,666,944 | 9/1997 | Ferguson | 431/115 |
| 5,775,317 | 7/1998 | Finke | 431/115 |
| 6,347,958 | 9/1994 | Gordon, Jr. | 431/115 |

FOREIGN PATENT DOCUMENTS

| | | | |
|---|---|---|---|
| 0226534 | 6/1987 | European Pat. Off. . | |
| 0445413 | 9/1991 | European Pat. Off. . | |
| 0050033 | 4/1977 | Japan | 431/115 |
| 0025701 | 3/1978 | Japan | 431/115 |
| 59-27109 | 2/1984 | Japan . | |
| 0188722 | 9/1985 | Japan . | |
| 406193821 | 7/1994 | Japan . | |

*Primary Examiner*—Carl D. Price
*Attorney, Agent, or Firm*—Harold J. Delhommer; Howrey & Simon

[57] ABSTRACT

The present invention relates to an apparatus and method for improving the economics of flue gas recirculation. In particular, the present invention relates to an apparatus for the minimization of oxides of nitrogen ("$NO_x$") in the exhaust gas of various combustion processes via balanced pressure drops of the recirculation gas, and a method for the calculation of flue gas recirculation percentage. The flue gas recirculation system achieves the balanced pressure drops by sizing the air intake line and recirculation line associated with the system.

10 Claims, 3 Drawing Sheets

FLUE GAS RECIRCULATION SYSTEM AND METHOD

BACKGROUND OF THE INVENTION

1. Field of the Invention

The present invention relates to an apparatus and method for improving the economics of flue gas recirculation. In particular, the present invention relates to an apparatus and method for the minimization of oxides of nitrogen ("$NO_x$") in the exhaust gas of various combustion processes.

2. Related Art

The minimization of oxides of nitrogen ("$NO_x$") in the exhaust gas of various combustion processes has been mandated by pollution control agencies throughout the country. Oilfield steam generators represent one of many industrial combustion processes where implementation of $NO_x$ control has become widespread. One of the ways in which $NO_x$ control is accomplished is to recirculate a percentage of the flue gas, or exhaust gas, (often 10%–20%) to mix with the inlet air.

The conventional $NO_x$ control systems, which utilize Flue Gas Recirculation ("FGR"), are extremely costly to manufacture, operate, and maintain due to the elaborate control systems that are required for effective performance of the system. Additionally, such systems, while substantially increasing generator operating cost, typically reduce the effective generator capacity.

One method of controlling the flue gas recirculation percentage is to provide control valves within the system to adjust the mixture of ambient air and flue gas to obtain a desired percentage. In the system disclosed in U.S. Pat. No. 5,040,470, the percentage of recirculated flue gas in the air inlet stream must be controlled to a reasonable precision. If this percentage is too high, generator output is reduced. If the percentage is too low, $NO_x$ reduction is insufficient. In this system, a control valve in the recirculation line is used to control the amount of flue gas recirculation. This valve works in tandem with the main air inlet valve, which controls the ambient air inlet rate. The main air inlet valve disclosed in U.S. Pat. No. 5,040,070 is itself a replacement for adjustable dampers, which are typically located between the blower and the burner section on units without $NO_x$ control. Under typical operating conditions, the main air inlet valve will be a source of significant frictional pressure drop, which must be overcome with additional energy consumption at the blower. To monitor the recirculation percentage, oxygen sensors are utilized. These sensors are used to monitor the percentage of flue gas recirculation, providing feedback to a recirculation rate control valve. The oxygen sensors add significantly to the expense of the system.

Conventional systems use active control in order to reach and maintain a selected recirculation percentage. Active control involves constant adjustment of control valves, and heat exchangers in order to operate the system at the selected recirculation percentage. Operators manually change valve settings or damper positions. In other systems, sensors integrated with control systems cause the system to alter relative valve positions and thermal conditions of the system in order to maintain the selected recirculation percentage. This active control adds significantly to the installation and operational costs of $NO_x$ control systems.

Other patents disclose controlling flue gas recirculation through an elaborate array of specialized burners, fans and dampers that alter the temperature of the flue gas in order to reduce noxious emissions. Such a system is disclosed in U.S. Pat. No. 4,659,305. This system uses conventional dampers and air diffusers, in conjunction with a recirculation fan, to enable the flue gas to be recirculated.

It is also desirable to calculate the flue gas recirculation percentage for monitoring purposes. Several conventional methods exist to calculate the percentage of flue gas recirculation (FGR). For example, oxygen sensors have been used to monitor the amount of oxygen in the combustion air. The percentage of FGR is then calculated from the oxygen sensor readings. However, the oxygen sensors are costly to install and maintain. Monitoring the flue gas recirculation percentage has also been achieved by metering the flow rate of the flue gas returned, or by performing a material balance using the temperature at different points in the system. However, the equations utilized to perform these calculations typically amount to a rough approximation of the actual flue gas recirculation percentage. The equations are generally inaccurate because they do not account for the heat added to the system by the mechanical inefficiencies in the blower.

Thus, there is a need in the art for a simple and inexpensive system for controlling flue gas recirculation percentage to minimize $NO_x$ emissions. Particularly, there is a need in the art for a system that eliminates the need for active control to maintain a selected flue gas recirculation percentage. There is a further need in the art for an improved method for calculating flue gas recirculation (FGR) percentage for monitoring purposes.

SUMMARY OF THE INVENTION

The present invention solves the problems with, and overcomes the disadvantages of conventional systems for flue gas recirculation and conventional methods of calculating the flue gas recirculation percentage.

The present invention relates to an apparatus and method for improving the economics of flue gas recirculation. In particular, the present invention relates to an apparatus and method for the minimization of oxides of nitrogen ("$NO_x$") in the exhaust gas of various combustion processes via maintaining balanced pressure drops of the recirculation gas.

In one aspect of the present invention, a flue gas recirculation system is provided. The system is used with a combustion generator for providing a selected percentage of flue gas recirculation. The system includes an exhaust stack for exhausting flue gas from the combustion generator. The exhaust stack has a stack inlet which is coupled to the combustion generator, a stack outlet which exhausts flue gas to the atmosphere, and a take off point. The take off point is a point along the exhaust stack between the stack inlet and the stack outlet. The system further includes a recirculation line that has a recirculation inlet which is coupled to the take off point, and a recirculation outlet. There is an air inlet line for providing air to the combustion generator. The air inlet line has an air inlet which is open to the atmosphere, and an air outlet which is coupled to the combustion generator. The recirculation outlet is coupled to the air inlet line at a combination point. The combination point is a point along the air inlet line between the air inlet and the air outlet. The air inlet line is sized relative to the size of the recirculation line such that the air inlet pressure drop plus the exhaust stack pressure drop equals the recirculation line pressure drop, thereby providing the selected percentage of flue gas recirculation.

The recirculation system may further be provided with a line having an inlet and an outlet. The outlet is coupled to the combustion generator and the inlet is coupled to a blower. The blower may have a variable speed drive.

In order to monitor the flue gas recirculation percentage, in another aspect of the invention, temperature sensors are provided in the recirculation system. The first temperature sensor is placed in the air inlet line. The second temperature sensor is placed in the recirculation line. The third temperature sensor is placed in the line connecting the blower and the combustion generator burner section. The temperatures are measured, and the flue gas recirculation percentage is calculated according to an equation which accounts for heat added to the system due to mechanical inefficiencies in the blower.

The flue gas recirculation percentage is calculated by using the temperature sensors described above. Three temperatures are measured: first temperature ($T_1$) at the first temperature sensor; a second temperature ($T_2$) at the second temperature sensor; and a third temperature ($T_3$) at the third temperature sensor. A temperature factor ($T_3'$) is then calculated by subtracting the temperature of the blower from $T_3$. Finally, the flue gas recirculation percentage is calculated using the following equation:

$$FGR = \frac{(1.015 * T_3' - T_1)}{(1.087 * T_2 - 1.015 * T_3')}$$

Accordingly, the present invention provides a system for flue gas recirculation wherein the recirculation is achieved by balanced pressure drops without active control of the system. The present invention further provides a method for calculating the flue gas recirculation percentage which takes into account the ambient effects of the system and the surrounding environment.

Features and Advantages

The invention provides a simple apparatus for flue gas recirculation and a method of calculating the flue gas recirculation percentage. The system is configured such that no active control is required to perform the flue gas recirculation. The system of the present application can typically be installed for 10% of the cost of existing systems. The system and method of the present invention simplifies operational control and compliance monitoring as compared with conventional systems.

Because the present system does not require an air inlet control valve, it is possible to utilize the balanced pressure drop approach to achieve simple, reliable control of the recirculation percentage. Considerable savings are obtained from not having to purchase and control an air inlet control valve.

The present invention can utilize a variable-speed drive for the blower to control the air inlet rate. The variable speed drive minimizes energy consumption.

Furthermore, the temperature sensors used in the system and method of the present invention are less costly and easier to use than the oxygen sensors of the conventional systems.

A simple pressure drop device, such an orifice plate or a manually operated butterfly valve, could be installed in the recirculation line to provide some adjustability to the system. However, once the desired recirculation percentage is obtained, on-line adjustment is not necessary.

Additional features and advantages of the invention will be set forth in the description that follows, and in part will be apparent from the description, or may be learned in practice of the invention.

BRIEF DESCRIPTION OF THE DRAWINGS

The accompanying drawings, which are incorporated in and constitute a part of this specification, illustrate embodiments of the invention and, together with the description, serve to explain the features, advantages, and principles of the invention.

DETAILED DESCRIPTION OF THE PREFERRED EMBODIMENTS

Reference will now be made in detail to the present preferred embodiments of the invention, examples of which are illustrated in the accompanying drawings. The exemplary embodiment of this invention is shown in some detail, although it will be apparent to those skilled in the relevant art that some features which are not relevant to the invention may not be shown for the sake of clarity.

Figure 1:
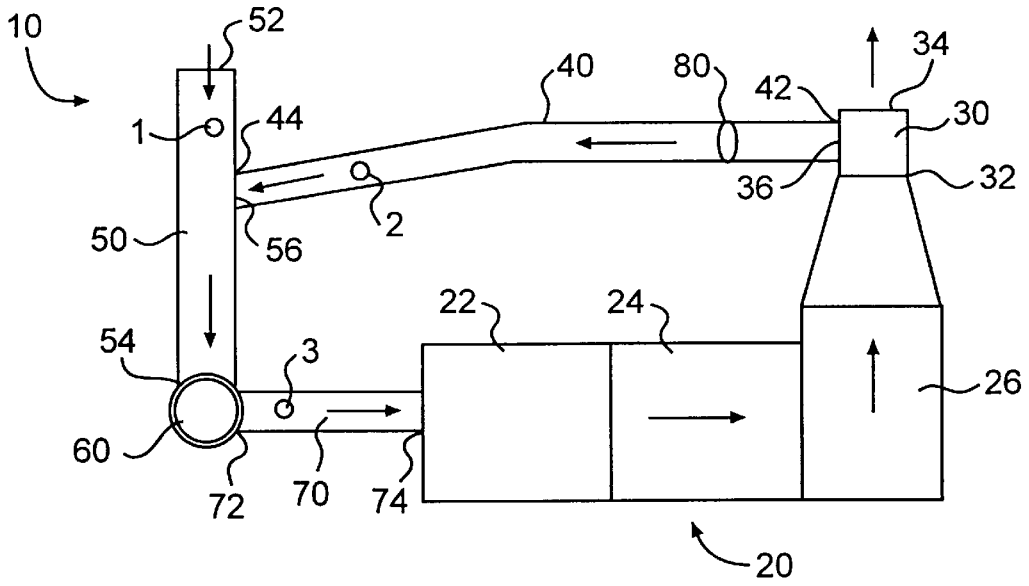
FIG. 1 is a side-elevation view of one embodiment of the system of the present invention.
Figure 2:
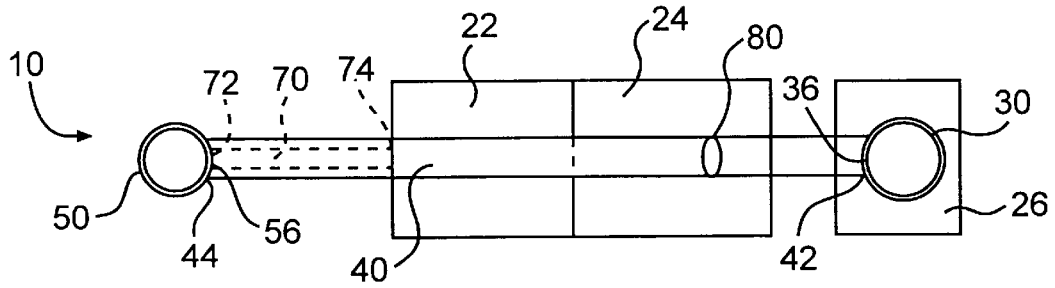
FIG. 2 is a plan view of the system shown in FIG. 1.

Referring first to FIGS. 1 and 2, there is illustrated an exemplary embodiment of the present invention. The arrows displayed in the figures are indicative of the airflow and gas flow direction.

A typical combustion generator 20 is coupled to a flue gas recirculation system shown generally by reference numeral 10. A recirculation line 40 provides communication between an exhaust stack 30 of the combustion generator 20 and an air inlet line 50 of the recirculation system 10. As would be readily apparent to one of skill in the relevant art, the combustion generator 20 comprises a burner section 22, a generator section 24, a convection section 26, and exhaust stack 30.

The air inlet line 50 has an air inlet 52, which is open to the atmosphere, and an air outlet 54 which feeds into the combustion generator 20.

The exhaust stack 30 has a stack inlet 32, a stack outlet 34 and a take off point 36. The stack inlet 32 is coupled to the combustion generator 20 and the stack outlet 34 is open to the atmosphere. The take off point 36 is disposed between the stack inlet 32 and the stack outlet 34.

The recirculation line 40 has a recirculation inlet 42 and a recirculation outlet 44. The recirculation inlet 42 is coupled to the take off point 36 and the recirculation outlet 44 is coupled to the air inlet line 50 at a point 56 between the air inlet 52 and the air outlet 54, also known as the combination point 56. The recirculation system 10 may also include a hose, or other type of line, 70 having a hose inlet 72 and a hose outlet 74. The hose outlet 74 is connected to the combustion generator 20 at the burner section 22. The hose inlet 72 is connected to a blower 60 disposed between the hose 70 and the air inlet line 50. The blower 60 is coupled to the air outlet 54 and the hose inlet 72. Blower 60 is preferably a variable speed drive blower.

In order to monitor the flue gas recirculation percentage, temperature sensors 1, 2, 3 are provided in the recirculation system 10. The first temperature sensor 1 is placed in the air inlet line 50. The second temperature sensor 2 is placed in the recirculation line 40. The third temperature sensor 3 is placed in the hose 70 connecting the blower 60 and the combustion generator burner section 22.

In order to force air to recirculate, the pressure at the combination point 56 must be less than that at the takeoff point 36. Since the stack 30 is typically designed to provide little frictional resistance to the exhausting flue gas, this implies that the blower 60 must operate to create a vacuum at the combination point 56. Therefore, the air inlet line 50 must be sized small enough to provide some frictional resistance to airflow, even at low firing rates. This is what drives the exhaust gas through the recirculation line 40. However, this pressure drop will be much less than required for a system employing a control valve on the air inlet line 50 or adjustable dampers, which results in an appreciable energy savings. Pressure drop balance refers to the fact that the amount of recirculation flue gas will be determined from the following equation:

Air Inlet pressure drop+Stack pressure drop=Flue Gas Recirculation line pressure drop Each of these pressure drops is, essentially, proportional to velocity squared. Thus, as the firing rate changes, each of these three pressure drops will go up (or down) in the same proportion. Thus, the diameter and length of the air inlet line 50 can be sized relative to the length and diameter of recirculation line 40 to provide a selected percentage of flue gas recirculation without active control of the system 10. The size and the shape of the air inlet line 50 can vary as long as the pressure drop ratio is sufficient to achieve the selected flue gas recirculation percentage.

By sizing the air inlet line 50 and the recirculation line 40, a pressure drop is achieved which allows the flue gas to recirculate to reduce $NO_x$ emissions. In order to fine tune the system 10, a simple pressure drop device 80, such as an orifice plate or a manually operated butterfly valve, can be installed. This pressure drop device 80 needs to be adjusted up to the point that the selected recirculation percentage is achieved. Upon reaching that point, further adjustment is not required.

The system 10 of the present invention reaches a steady-state operating condition where the pressures at the combination point 56 and the take off point 36 are maintained such that the condition of the system 10 does not change over time. Any change in pressure that does take place at either of the points will be continually balanced by a corresponding change in pressure at the other point. Particularly, air inlet line 50 is sized relative to recirculation line 40 such that the air inlet pressure drop (at combination point 56) plus the stack pressure drop (at take off point 36) equals the recirculation line 40 pressure drop. In this manner, the system 10 of the present invention passively maintains this steady-state condition of the selected percentage of flue gas recirculation. No active control of the system 10, such as operation of valves or dampers, is required to maintain the operation of the system and, accordingly, the selected recirculation percentage.

As noted above, in order to monitor the flue gas recirculation percentage, temperature sensors 1, 2, 3 are installed in the system 10. The first temperature sensor 1 is installed in the air inlet line 50, above the combination point 56 as shown in FIG. 1. This allows the temperature of the ambient air to be measured. The second temperature sensor 2 is installed in the recirculation line 40. This allows the temperature of the flue gas to be measured at a point prior to reaching the combination point 56. The third temperature sensor 3 is located downstream of the blower 60 in the hose 70 which connects the blower 60 with the burner section 22 of the combustion system 20. The location of the third temperature sensor 3 downstream of the blower 60 causes some complexities in calculating the flue gas recirculation percentage due to the heat that the blower 60 adds to the mixed air and flue gas. Placing the third temperature sensor 3 upstream of the blower would have avoided this complexity, but the air would not be mixed well enough at this location to allow the precise measurements that are required for these calculations.

The typical equation that is used in calculating the flue gas recirculation percentage (FGR) is the following, where subscripts 1, 2, and 3 refer to locations of the temperature sensors one, two, and three as shown in the figures:

$$FGR = \frac{[Rate_2]}{[Rate_1 + Rate_2]} = \frac{[Rate_2]}{[Rate_3]}$$

From energy balance, assuming equal specific heat in each flow stream, $$(Rate_1 * Temp_1) + (Rate_2 * Temp_2) = (Rate_3 * Temp_3)$$

Combining and simplifying gives, $$FGR = \frac{[Temp_3 - Temp_1]}{[Temp_2 - Temp_1]}$$

An analogous equation, based on oxygen concentrations, can be used to monitor the process with oxygen sensors. However, these equations do not account for the heat added to the system due to mechanical inefficiencies of the blower 60. In contrast to conventional systems, the present invention utilizes the following equation in order to account for such additional heat $$FGR = \frac{[1.015 * T_3' - T_1]}{[1.087 * T_2 - 1.015 T_3']},$$

where $T_3'$ is the difference between the temperature at the third temperature sensor 3 and the temperature change of the blower 60.

The above equation is derived as follows:

From Conservation of Energy:

$$M_1 Cp_1 T_1 + M_2 Cp_2 T_2 = M_3 Cp_3 (T_3 - \Delta T_{Blower})$$

but:

$$M_3 = M_1 + M_2$$

and:

$$\Delta T_{Blower} = \frac{U_{Blower}}{M_3 Cp_3}.$$

Expanding the previous equation:

$$\Delta T_{Blower} = \frac{42.42(1 - \eta_{Blower}) HP_{Blower}}{(1 + FGR) Cp_3 Q_{gas} \gamma_{gas} \rho_{air} AFR}$$

But, knowing the affinity power relationships:

$$HP_1 = HP_2 \frac{T_2}{T_1} \left(\frac{N_1}{N_2}\right)^3$$

and calculating that:

$$Cp_3 \cong 1.015 Cp_1 = 0.2422 \frac{BTU}{lb_m - F^\circ}$$

$$Cp_2 \cong 1.087 Cp_1 = 0.2586 \frac{BTU}{lb_m - F^\circ}$$

and by assuming a 15% FGR, 1.5% $O_2$, 0.6 gas S.G., 60% $\eta_{Blower}$ (thermal efficiency of blower), 19 AFR, and 0.076303 lb/ft$^3$ air density (STP=60° F.); and having measured a motor load of 83.51 HP at 2,070 RPM and 102° F., then:

$$\Delta T_{Blower} = \frac{4{,}887{,}074{,}500\left(\frac{N}{2{,}070}\right)^3}{(T_3 + 460)Q_{gas}}.$$

Let:

$$T_3' = T_3 - \Delta T_{Blower}$$

Then combining terms we find that the ratio of flue gas to air (FGR) is:

$$\frac{M_2}{M_1} = \frac{1.015T_3' - T_1}{1.087T_2 - 1.015T_3'}$$

Where M is the Mass flow rate,
HP is in horsepower,
N is in RPM,
T is in ° F.,
Cp is the specific heat in BTU/lbm-F°,
$Q_{gas}$ (natural gas burned) is in Standard Cubic Feet per day,
FGR is the flue gas recirculation ratio, $M_2/M_1$, and
AFR is air to fuel ratio.

To more clearly describe the system, the following example is given. It is to be understood that the details and calculations shown below are simplified to describe the primary factors involved in calculating the flue gas recirculation percentage of a combustion system 20 as described. As would be apparent to one of ordinary skill in the art, other secondary factors may affect the flue gas recirculation percentage. This example should not represent any limitation on the present invention. Corresponding reference numerals will be used where appropriate.

Figure 3:
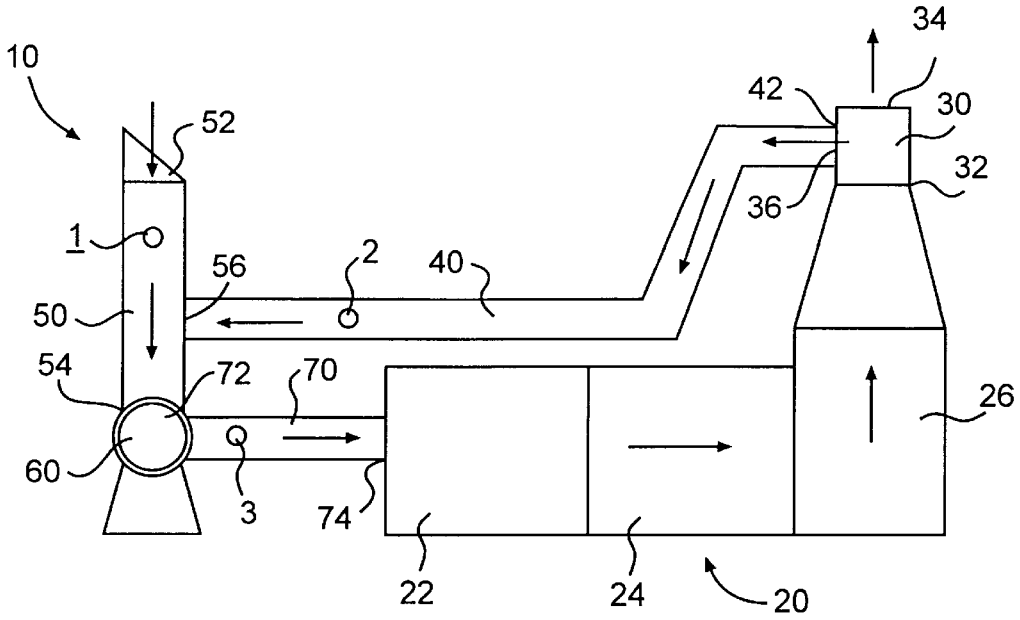
FIG. 3 is a side-elevation view of another embodiment of the system of the present invention.
Figure 4:
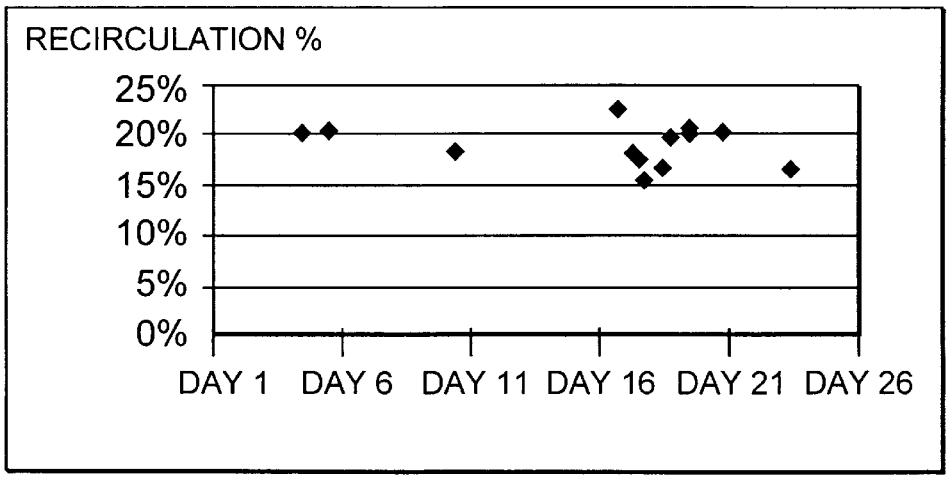
FIG. 4 is a graph of results (Recirculation % as a function of time) using the system shown in FIG. 3.

The above-described system 10 has been implemented and tested. The system 10 shown in FIG. 3, depicts a flue gas recirculation system 10 coupled to a combustion generator 20. The system depicted in FIG. 3 is different from the embodiment in FIG. 1 in that the recirculation line is oriented differently and there is no flow restriction device depicted. It should be understood that the present invention does not require any particular orientation for recirculation line 40, nor does it require a flow restriction device in the recirculation line. The system functions along the same principles and is included herein as one example of a specific configuration of the system of the present invention. In the embodiment shown in FIG. 3, the flue gas recirculation system 10 includes an air inlet line 50 that is four feet long and eighteen inches in diameter. The stack 30 is sized large enough such that pressure losses are negligible. Since the diameter (i.e the ratio of the diameter of the air inlet line to the diameter of the recirculation line is about 1.8:1) of the exhaust stack 30 is sized so large, the pressure loss at the stack outlet 34 will not effect the pressure drop at the take off point 36 and the combination point 56. The recirculation line 40 is sixty feet long and ten inches in diameter. Temperature data from an installation with this geometry was used to track the recirculation percentage of an operating generator, the results of which are shown in FIG. 4. The flue gas recirculation percentage fluctuated between 16% and 22%. The standard deviation of this data is 2 percentage points.

Figure 5:
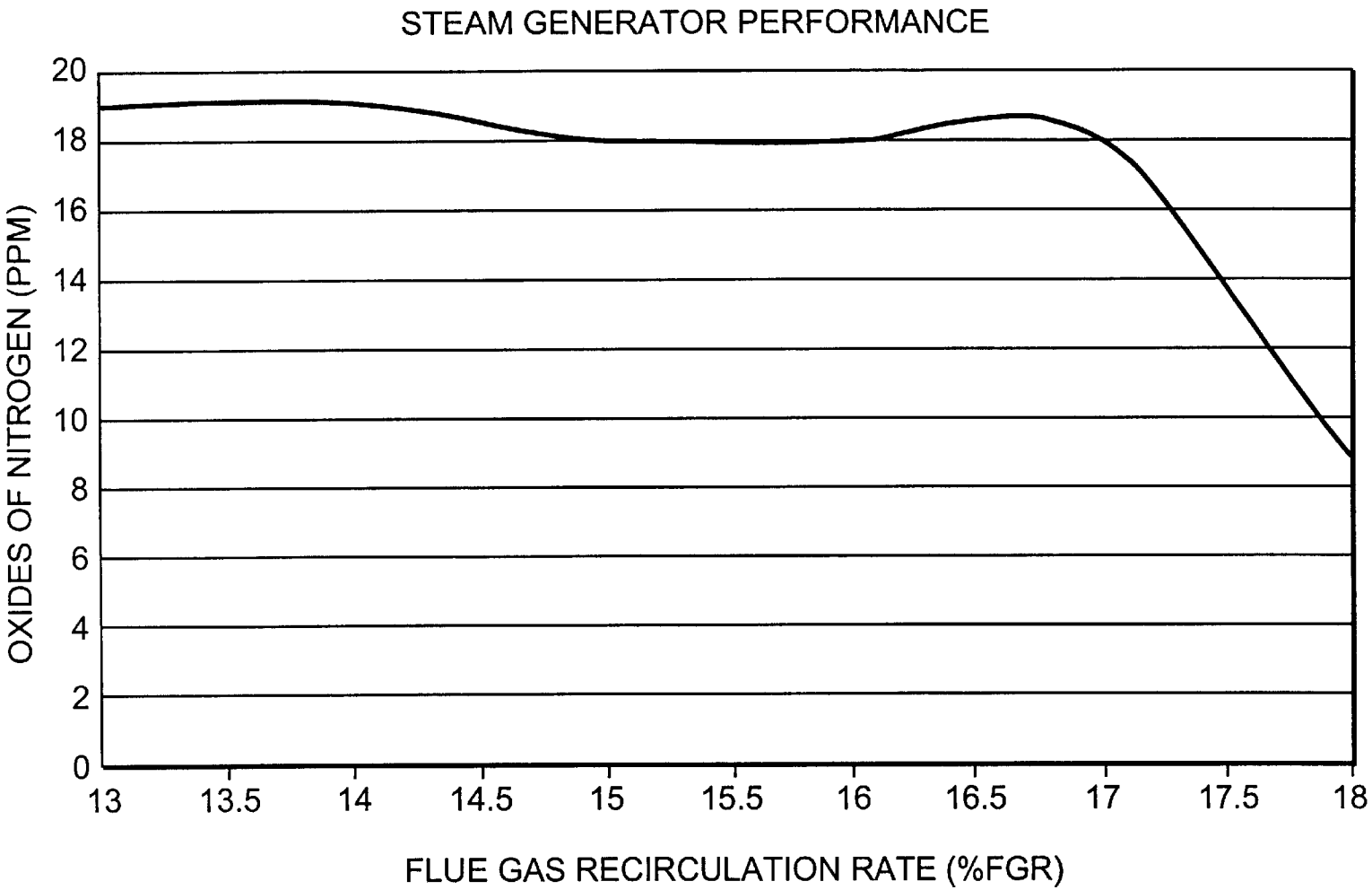
FIG. 5 is a graph of steam generator performance (oxides of nitrogen in parts per million (ppm) as a function of Flue Gas Recirculation (FGR %))using the system of the present invention.

$NO_x$ emissions at the generator depicted in FIG. 3, as measured with a separate analyzer, have been kept well below the allowable value of 30 ppm. Tests on other generators demonstrate that the recirculation percentage can be as low as 10%, and still achieve the desired $NO_x$ control of less than 30 ppm. FIG. 5 depicts a graph of steam generator performance using the system of the present invention. Particularly, a graph of oxides of nitrogen (ppm) as a function of Flue Gas Recirculation rate (% FGR) is shown. As is apparent, the system of the present invention consistently achieves $NO_x$ values well below 30 ppm over a considerable range of % FGR (13–18%). As demonstrated by FIG. 5. the system of the present invention can achieve $NO_x$ values below 10 ppm. The system used to obtain the data shown in both FIGS. 4 and 5 did not contain a pressure drop device 80 in recirculation line 40, thereby demonstrating the effectiveness of the system of the present invention, and the efficacy of the steady-state configuration.

As described above, and as shown in the above example, the present invention provides a simple system for flue gas recirculation. It should be apparent that the present invention may be used to increase efficiency, to lower equipment costs and operating costs, and to simplify the calculation of flue gas recirculation percentage while achieving more accurate results.

Conclusion

While various embodiments of the present invention have been described above, it should be understood that they have been presented by way of example only, and not limitation. Thus, the breadth and scope of the present invention should not be limited by ally of the above-described exemplary embodiments, but should be defined only in accordance with the following claims and their equivalents.

We claim:

1. A method for determining flue gas recirculation percentage comprising:

measuring a first temperature ($T_1$) at a first temperature sensor in an air inlet line for providing air to a combustion generator;

measuring a second temperature ($T_2$) at a second temperature sensor in a recirculation line coupled between the air inlet line and an exhaust stack of the combustion generator;

measuring a third temperature ($T_3$) at a third temperature sensor in a line coupled between a blower and a burner section of the combustion generator;

calculating a temperature factor ($T_3'$) by subtracting the temperature of said blower from $T_3$; and calculating the flue gas recirculation (FGR) percentage in accordance with the following equation $$FGR = \frac{(1.015 * T_3' - T_1)}{(1.087 * T_2 - 1.015 * T_3')}.$$

2. The method of claim 1, wherein $T_1$ is measured at the first temperature sensor which is disposed upstream of the point where the air inlet line is coupled to the recirculation line and $T_3$ is measured at the third temperature sensor which is disposed downstream of the blower.

3. The method of claim 2, wherein $T_1$ is measured upstream of $T_3$.

4. The method of claim 1, further comprising the step of passively maintaining the calculated FGR percentage to achieve a corresponding reduction in $NO_x$ emission.

5. The method of claim 4, wherein said step of passively maintaining the calculated FGR percentage comprises sizing the air inlet line relative to the recirculation line such that an air inlet pressure drop plus an exhaust stack pressure drop equals a recirculation line pressure drop.

6. The method of claim 4, wherein said step of passively maintaining the calculated FGR percentage comprises sizing the recirculation line such that the pressure where the recirculation line couples the air inlet line is less than the pressure where the recirculation line couples the exhaust stack.

7. The method of claim 4, wherein said step of passively maintaining the calculated FGR percentage comprises sizing the air inlet line such that the pressure where the recirculation line couples the air inlet line is less than the pressure where the recirculation line couples the exhaust stack.

8. The method of claim 4, further comprising: providing a flow restriction device in the recirculation line.

9. The method of claim 8, wherein the flow restriction device is an orifice plate.

10. The method of claim 8, wherein the flow restriction device is a valve.

* * * * *